US011231684B2

(12) United States Patent
Carlisle

(10) Patent No.: US 11,231,684 B2
(45) Date of Patent: Jan. 25, 2022

(54) TIMEKEEPING DEVICE WITH EIGHT-HOUR MOVEMENT

(71) Applicant: Richard Sheldon Carlisle, Madrid, NY (US)

(72) Inventor: Richard Sheldon Carlisle, Madrid, NY (US)

( * ) Notice: Subject to any disclaimer, the term of this patent is extended or adjusted under 35 U.S.C. 154(b) by 242 days.

(21) Appl. No.: 16/693,294

(22) Filed: Nov. 23, 2019

(65) Prior Publication Data

US 2021/0157272 A1 May 27, 2021

(51) Int. Cl.
*G04B 19/08* (2006.01)

(52) U.S. Cl.
CPC ..... *G04B 19/085* (2013.01); *G04B 19/087* (2013.01)

(58) Field of Classification Search
CPC .. G04B 19/082; G04B 19/247; G04B 19/264; G04B 19/08; G04B 19/085; G04B 19/087
See application file for complete search history.

(56) References Cited

U.S. PATENT DOCUMENTS 4,435,640 A * 3/1984 Micheletto ..... G04B 19/26 235/78 M
4,717,260 A * 1/1988 Tsuji ..... G04B 19/223 368/21
5,524,102 A * 6/1996 Liao ..... G04B 19/223 368/21
6,577,558 B1 * 6/2003 Ricci ..... G04B 19/082 368/228
7,433,270 B2 * 10/2008 Chen ..... G04B 19/23 368/21
9,448,536 B1 * 9/2016 Kahn ..... G04B 5/08
9,459,590 B1 * 10/2016 Lecher ..... G04C 17/0091
2011/0308445 A1 * 12/2011 Avda ..... G04B 19/08 116/201
2012/0307603 A1 * 12/2012 Bongio ..... G04G 13/021 368/243
2016/0259299 A1 * 9/2016 Kahn ..... G04B 47/063
2019/0146421 A1 * 5/2019 Rogers ..... G04F 3/06 368/108

* cited by examiner

*Primary Examiner* — Sean Kayes
(74) *Attorney, Agent, or Firm* — Ingenium Patents LLC; Peter R. Kramer

(57) ABSTRACT

The subject invention is a timekeeping device having a dial with eight evenly spaced hour indicators and one hand rather than two, for indicating both hours and minutes. For optimal accuracy the spaces between the hour marks contain eleven evenly spaced marks that indicate five-minute intervals. At the top of the dial there are three numerals 12, 8, and 4. On the bottom side of the dial are the same three numerals 4, 12, and 8. The numbers are in such order that noon can be placed at the top or bottom and all times will read properly. Additionally, all PM numbers can be increased by 12 to form a 24-hour dial.

5 Claims, 1 Drawing Sheet

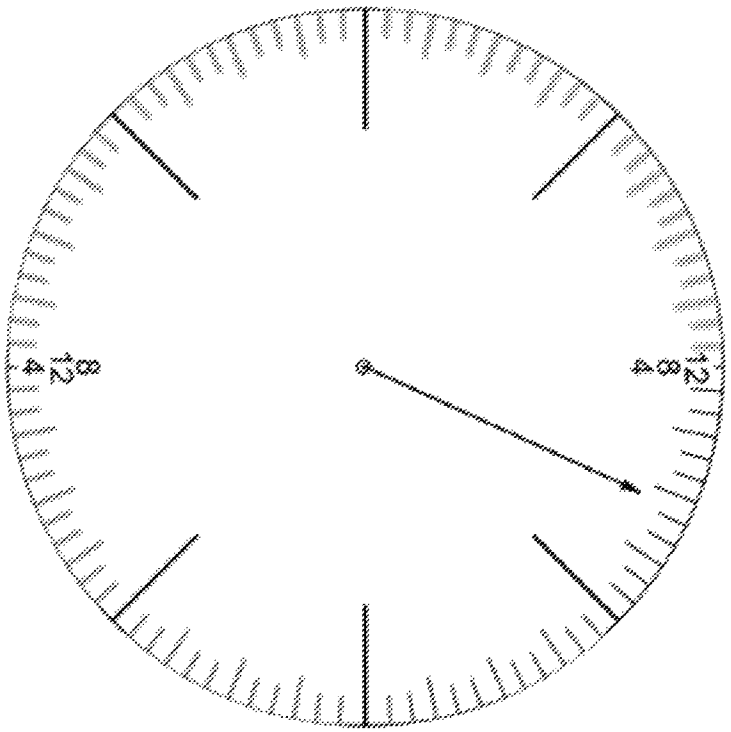
12
8
4
8
12
4

TIMEKEEPING DEVICE WITH EIGHT-HOUR MOVEMENT

BACKGROUND OF THE INVENTION

One-hand timepieces have been known dating back to the sundial, followed by tower clocks, the four-hour dial, the six-hour dial, twelve-hour dial, and finally, 24-hour dial. The four and six-hour-dial types have had six and four subdials respectively, to represent all 24 hours of a typical day. The twelve-hour dial is easier to learn and is more understandable than the four-and-six-hour dial but the 12-hour dial provides inadequate space to indicate minutes. The 24-hour dial provides even less space to indicate minutes.

BRIEF SUMMARY OF THE INVENTION

A timekeeping device is provided with eight evenly spaced hour marks and between the hour marks are 11 evenly spaced minute marks that represent 5 minutes. The hour marks can be numbered in a way to place midnight or noon at the top of the dial and the PM mark numbers can be increased, adding 12 to each to establish a 24-hour (military) format. preferably the hour marks are comprised of two columns of numbers and six hour mark lines.

The subject eight-hour dial allows uncluttered room for minutes and is easy to learn because all hour values are duplicated exactly across the dial from one another, thus reducing the learning curve substantially. The subject invention was actually a discovery. It happened because a watch owned by the inventor was running 50% too fast and could not be easily corrected. Thus, the best remedy for the overly fast movement was to make an eight-hour dial that could accurately accommodate the faulty watch.

The subject invention with an eight-hour dial provides a unique advantage that sets it apart from all others: All three values for each of the daily 24 hours are repeated exactly across the dial from each other, thus making the format much easier to learn since knowing just half of the positions implicitly means the other half are also known. Another feature not found in other dial formats is that the starting point of the day (12 AM) can be placed at either the top or bottom of the dial. And finally, the dial can be set in a 24-hour format simply by adding 12 to each of the PM hours.

BRIEF DESCRIPTION OF THE DRAWING

The drawing shows a timekeeping dial with eight evenly spaced hour mark lines, 11 evenly spaced minute mark lines between the first two hours and three numbers at the top of the dial to indicate 12 AM, 8 AM and 4 PM and three numbers at the bottom to indicate 4 AM, 12 PM and 8 PM.

DETAILED DESCRIPTION OF THE INVENTION

A timekeeping device having one hand and eight evenly spaced hour marker lines with 11 smaller minute marker lines between the hour marker lines provides one-hand simplicity and adequate space between hour marker lines to accurately indicate time to the nearest minute. The eight-hour format provides distinct advantages over previous one-hand timekeeping devices. For example, the hand is always within two hours (% of the dial) of one of the upper or lower reference points, so that a user can easily go back or forward to one of the points and determine what hour of the day the hand is indicating and then determine the exact minutes. For a dial to provide this function, the number of hours in the dial must be less than 24 but the number must be evenly divisible into 24 but not divisible into 12. Hence an eight-hour dial is optimal.

Alternatively, the dial may contain hour marks without five-minute marks, and the watch face may have a subdial with a minute-hand or an image of a minute-hand which sweeps through 360 degrees in a one-hour period. The subdial could have 12 five-minute marks or another suitable arrangement of minute marks.

A watch or clock can be made having an electrically or spring-powered movement which turns a shaft to which the hand is affixed. Alternatively, a processor or microprocessor and screen can be utilized to create an image of a moving hand. The screen could have hour marks and five-minute marks inscribed or images of the marks can be generated along with generating the image of the moving hand. A watch would normally include a movement, a shaft, to turn the clock or watch hand, a crystal or a glass plate for a clock, a case, a crown for adjustment of the hand position and or winding a spring on a watch or an adjustment/winding knob for a clock, and a bezel for a watch.

I claim:

1. A timekeeping device comprising, a hand, a dial or face, and an eight-hour movement, wherein said hand sweeps through 360 degrees in an eight-hour time period, a first vertical column of indicia, said first vertical column of indicia positioned near a top edge of said dial or face, wherein said first vertical column of indicia is comprised of three numerals, said three numerals of said first vertical column comprised of a first numeral 12, a first numeral eight, and a first numeral four, wherein said first numeral twelve is positioned above said first numeral eight, and further wherein said first numeral eight is positioned above said first numeral four, a second vertical column of indicia, said second vertical column of indicia positioned near a bottom edge of said dial or face, wherein said second vertical column of indicia is comprised of three numerals, wherein the three numerals of said second vertical column are comprised of a second eight, a second twelve, and a second four, and further wherein said second numeral eight is positioned above said second numeral twelve, and yet further wherein said second numeral twelve is positioned above said second numeral four, a first hour mark, said first hour mark being comprised of said first vertical column of indicia, a second hour mark, said second hour mark being comprised of said second vertical column of indicia, third, fourth, and fifth hour marks, wherein said third, fourth, and fifth hour marks are positioned on a right side of said dial or face between said first and second hour marks, sixth, seventh, and eighth hour marks, wherein said sixth, seventh, and eighth hour marks are evenly placed on a left side of said dial or face between said first and second hour marks.

2. The timekeeping apparatus of claim 1 further comprising 88 five-minute marks, said marks arranged wherein there are eight groups of 11 five-minute marks, wherein the 11 five-minute marks of each of the respective eight groups of eleven five-minute marks are evenly distributed between each respective pair of adjacent hour marks, wherein any two adjacent hour marks differ by one hour, and further wherein a five-minute time interval is indicated between each five-minute mark and its adjacent mark or marks.

3. A timekeeping device with a dial having eight equally spaced hour markers, a column of numerical indicia located at the top and bottom of said dial, said indicia at the top and bottom of the dial each comprised of three numerical indicia, wherein each of the columns of numerical indicia are comprised of the same three numerical indicia; an eight hour movement configured to rotate at least one hour hand one full rotation every 8 hours, and wherein the three numeric indicia are hour indicia that cooperate with the at least one hour hand.

4. The device according to claim 3 having only one hand, wherein some of said eight hour markers not at the top or bottom of said dial also having numerical indicia, and further wherein each of said eight hour markers are located directly across the dial from an opposing hour marker, each pair of opposing hour markers differing in position by four hours, wherein any pair of opposing hour markers not at the top or bottom of said dial which also have said numerical indicia, further having said numerical indicia comprised of a same set of numerical values.

5. The device according to claim 4 being installed in a workplace setting, whereby employees can estimate the portion of the workday accomplished at any point in time and when the said hand reaches the same position it was at the beginning of the workday it signifies the completion of an eight-hour work shift.

* * * * *